US009925764B2

(12) United States Patent
Shiiya

(10) Patent No.: US 9,925,764 B2
(45) Date of Patent: Mar. 27, 2018

(54) PRINTING APPARATUS AND POSITION ADJUSTING METHOD OF MARK DETECTOR

(71) Applicant: SEIKO EPSON CORPORATION, Tokyo (JP)

(72) Inventor: Tomoyuki Shiiya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/491,591

(22) Filed: Apr. 19, 2017

(65) Prior Publication Data

US 2017/0305147 A1 Oct. 26, 2017

(30) Foreign Application Priority Data

Apr. 26, 2016 (JP) ..... 2016-087877

(51) Int. Cl.
*B41J 2/045* (2006.01)
*B41J 2/21* (2006.01)

(52) U.S. Cl.
CPC ..... *B41J 2/04505* (2013.01); *B41J 2/04586* (2013.01); *B41J 2/2135* (2013.01)

(58) Field of Classification Search
CPC .... B41J 2/04505; B41J 2/2135; B41J 29/393; B41J 11/46; B41J 13/26; B41J 2/04508; B41J 3/407; B41J 11/008; B41J 2/04586; H04N 1/12
See application file for complete search history.

(56) References Cited

U.S. PATENT DOCUMENTS

2009/0002410 A1* 1/2009 Shirota ..... B41J 2/04513 347/8

FOREIGN PATENT DOCUMENTS

JP 2005-096228 4/2005

* cited by examiner

*Primary Examiner* — Thinh H Nguyen
(74) *Attorney, Agent, or Firm* — Workman Nydegger

(57) ABSTRACT

There is provided a printing apparatus including: a mark detector which detects a mark that is formed on a recording medium and has a width in a first direction in a detection region thereof, and is supported to be rotatable around a rotation shaft that is parallel to a second direction intersecting with the first direction; a driving portion which drives the mark detector in the first direction; an angle determination portion which determines a rotation angle of the mark detector that considers the rotation shaft as a center; and a control portion which matches positions of the detection region and the mark in the first direction by adjusting a position of the mark detector in the first direction by the driving portion based on the rotation angle of the mark detector which is determined by the angle determination portion.

6 Claims, 6 Drawing Sheets

PRINTING APPARATUS AND POSITION ADJUSTING METHOD OF MARK DETECTOR

BACKGROUND

1. Technical Field

The present invention relates to a technology for detecting a mark formed on a recording medium by a mark detector.

2. Related Art

In the related art, a printing apparatus which prints an image on a recording medium transported in a predetermined transport direction is known. In addition, in a printing apparatus (ink jet recording device) of JP-A-2005-96228, a technology for controlling a transport amount of the recording medium based on a result of detecting a plurality of marks which are aligned in the transport direction and are formed on the recording medium by an optical sensor, is described.

However, there is a case where it is appropriate to detect a mark by appropriately changing an angle of a mark detector, such as an optical sensor, in order to respond to a difference in reflectivity of the recording medium, or the like. However, when changing the angle of the mark detector, there is a concern that a position of a detection region in which the mark detector detects the mark varies, and the detection region of the mark detector causes a position shift with respect to the mark.

SUMMARY

An advantage of some aspects of the invention is to provide a technology which can appropriately maintain a positional relationship between a detection region of a mark detector and a mark regardless of an angle of the mark detector.

The invention can be realized in the following aspects.

According to a first aspect of the invention, there is provided a printing apparatus including: a mark detector which detects a mark that is formed on a recording medium and has a width in a first direction in a detection region thereof, and is supported to be rotatable around a rotation shaft that is parallel to a second direction intersecting with the first direction; a driving portion which drives the mark detector in the first direction; an angle determination portion which determines a rotation angle of the mark detector that considers the rotation shaft as a center; and a control portion which matches positions of the detection region and the mark in the first direction by adjusting a position of the mark detector in the first direction by the driving portion based on the rotation angle of the mark detector which is determined by the angle determination portion.

According to a second aspect of the invention, there is provided a position adjusting method of a mark detector including: driving a mark detector which detects a mark that is formed on a recording medium and has a width in a first direction in a detection region thereof, and is supported to be rotatable around a rotation shaft that is parallel to a second direction intersecting with the first direction, in the first direction, in which, in the driving of the mark detector in the first direction, positions of the detection region and the mark are matched in the first direction by adjusting a position of the mark detector in the first direction based on a rotation angle of the mark detector that considers the rotation shaft as a center.

In the invention (first and second aspects) configured in this manner, the positions of the detection region and the mark are matched in the first direction by adjusting the position of the mark detector in the first direction based on a rotation angle of the mark detector. Therefore, it is possible to appropriately maintain a positional relationship between the detection region of the mark detector and the mark regardless of the angle of the mark detector.

In the printing apparatus, a storage portion which stores the position of the mark in the first direction, may be provided, and the control portion may match positions of the detection region and the mark in the first direction by adjusting the position of the mark which is stored in the storage portion and a position in the first direction of the mark detector by the driving portion based on the rotation angle of the mark detector which is determined by the angle determination portion. In the configuration, it is possible to appropriately position the detection region of the mark detector with respect to the mark based on the position of the mark in the first direction stored in the storage portion and the rotation angle of the mark detector.

In the printing apparatus, a mark position input portion which receives an input of information indicating the position of the mark in the first direction, may be provided, and the storage portion may store the position of the mark indicated by the information input to the mark position input portion. In the configuration, it is possible to simply obtain the position of the mark in the first direction based on the input to the mark position input portion.

In the printing apparatus, the control portion may confirm the position of the mark in the first direction based on a result of monitoring a detected value of the mark detector while moving the mark detector in the first direction by the driving portion, and the storage portion may store the position of the mark confirmed by the control portion. In the configuration, it is possible to obtain the position of the mark in the first direction with high accuracy.

In the printing apparatus, a medium type input portion which receives an input of a type of the recording medium; and an angle instruction portion which gives an instruction to adjust the rotation angle of the mark detector to an angle which corresponds to the type of the recording medium input to the medium type input portion, may be provided, and the angle determination portion may determine the rotation angle of the mark detector based on the type of the recording medium input to the medium type input portion. In the configuration, it is possible to adjust the rotation angle of the mark detector to an appropriate angle which corresponds to the type of the recording medium, and to appropriately maintain the positional relationship between the detection region of the mark detector and the mark regardless of the rotation angle of the mark detector.

In addition, in order to solve a part or the entirety of the above-described problem, or in order to achieve a part or the entirety of the effects described in the specification, all of the above-described plurality of configuration elements in each aspect of the invention are not necessary, and a part of the plurality of configuration elements can be appropriately changed, removed, or switched to other new configuration elements, and partial removal of limited contents is possible. In addition, in order to solve a part or the entirety of the above-described problem, or in order to achieve a part or the entirety of the effects described in the specification, a part or the entirety of technical characteristics included in one aspect of the above-described invention can be combined with a part or the entirety of the technical characteristics included in other above-described aspects of the invention, and can also be one independent aspect of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
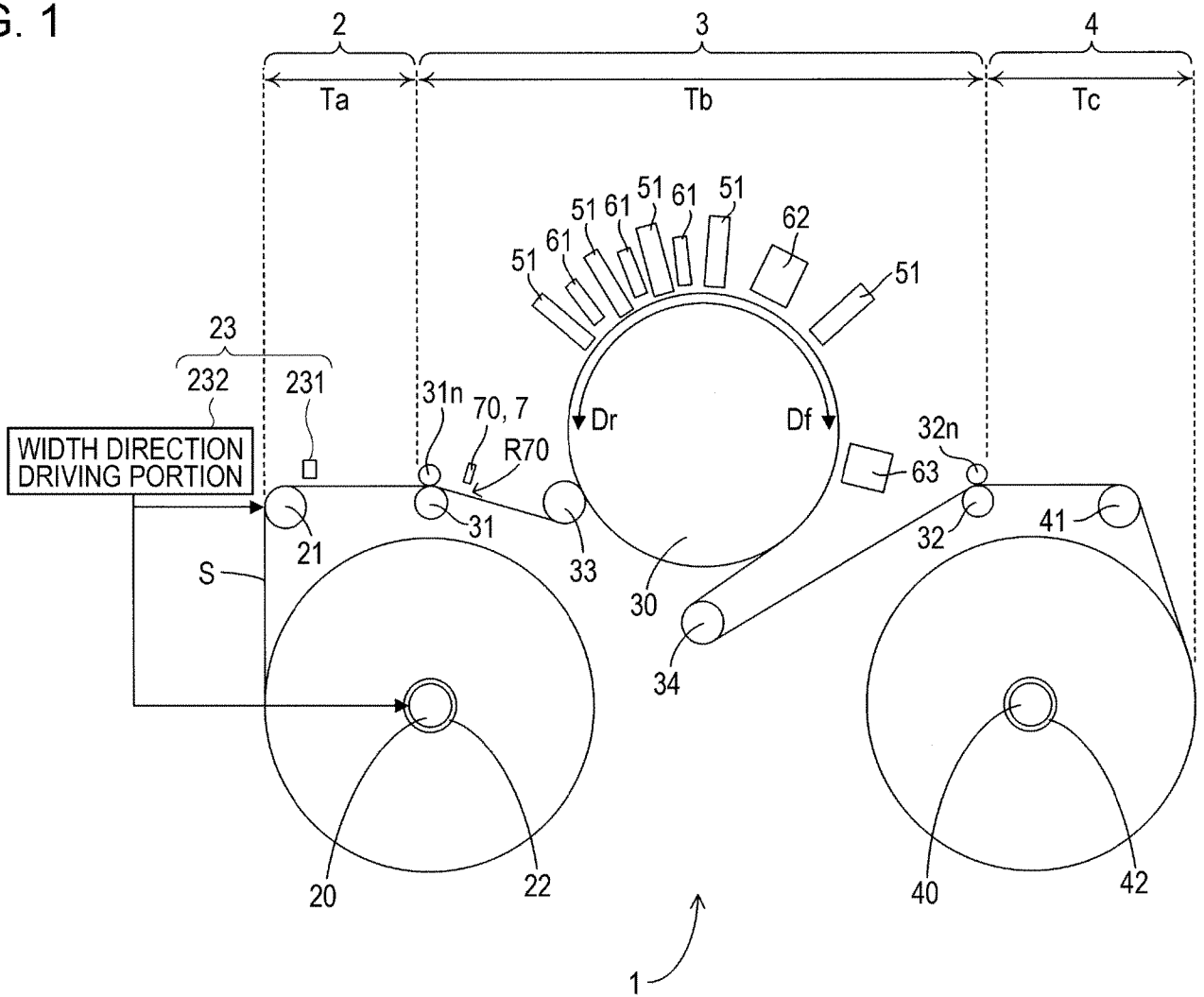
FIG. 1 is a front view illustrating an example of an apparatus configuration of a printer which employs the invention.

FIG. 1 a front view schematically illustrating an example of an apparatus configuration of a printer which employs the invention. As illustrated in FIG. 1, in a printer 1, one web S of which both ends are wound around a delivery shaft 20 and a winding shaft 40 in a rolled shape stretches along a transport path, and the web S receives printing while being transported in a normal direction Df which is toward the winding shaft 40 from the delivery shaft 20. The type of the web S is broadly classified into a paper type and a film type. Specific examples of the paper type include a pure paper sheet, a cast paper sheet, an art paper sheet, or a coated paper sheet, and specific examples of the film type include a synthetic paper sheet, a polyethylene terephthalate (PET) or a polypropylene (PP). Schematically, the printer 1 includes a delivery portion 2 (delivery region) which delivers the web S from the delivery shaft 20, a process portion 3 (process region) which prints an image on the web S delivered from the delivery portion 2, and a winding portion 4 (winding region) which winds the web S on which the image is printed by the process portion 3 around the winding shaft 40. In addition, in the following description, regarding both surfaces of the web S, while a surface on which the image is printed is referred to as a front surface, a surface on a side reverse thereto is referred to as a rear surface.

The delivery portion 2 includes the delivery shaft 20 around which an end of the web S is wound, and a driven roller 21 around which the web S pulled out from the delivery shaft 20 is wound. The delivery shaft 20 winds and supports the end of the web S in a state where the front surface of the web S is toward the outside. In addition, as the delivery shaft 20 rotates in a clockwise direction of FIG. 1, the web S wound around the delivery shaft 20 is delivered to the process portion 3 via the driven roller 21. Incidentally, the web S is wound around the delivery shaft 20 via a core tube 22 which is attachable to and detachable from the delivery shaft 20. Therefore, when the web S of the delivery shaft 20 is used up, a new core tube 22 around which the rolled web S is wound is mounted on the delivery shaft 20, and the web S of the delivery shaft 20 can be exchanged.

The delivery shaft 20 and the driven roller 21 can move in a width direction Dw (direction perpendicular to a paper surface of FIG. 1) orthogonal to the normal direction Df, and the delivery portion 2 includes a steering mechanism 23 which suppresses meandering of the web S by adjusting the positions of the delivery shaft 20 and the driven roller 21 in the width direction (axial direction). The steering mechanism 23 is configured of an edge sensor 231 and a width direction driving portion 232. The edge sensor 231 is provided to oppose the end in the width direction of the web S on the downstream side in the normal direction Df of the driven roller 21, and detects the position of the end of the web S in the width direction. In addition, the width direction driving portion 232 moves the delivery shaft 20 and the driven roller 21 in the width direction in accordance with the detection result of the edge sensor 231. In this manner, the meandering of the web S is suppressed.

The process portion 3 records an image on the web S by appropriately performing the treatment by each of the functional portions 51, 61, 62, and 63 which are disposed along the outer circumferential surface of a rotation drum 30 while supporting the web S delivered from the delivery portion 2 by the rotation drum 30. In the process portion 3, a forward driving roller 31 and a rearward driving roller 32 are provided on both sides of the rotation drum 30, the web S transported in the normal direction Df to the rearward driving roller 32 from the forward driving roller 31 is supported by the rotation drum 30 and receives the printing.

The forward driving roller 31 has a plurality of fine projections formed by thermal spraying on an outer circumferential surface, and winds the web S delivered from the delivery portion 2 from the rear surface side. In addition, the forward driving roller 31 transports the web S delivered from the delivery portion 2 to the downstream side in the normal direction Df by rotation thereof in a clockwise direction of FIG. 1. In addition, a nip roller 31*n* is provided with respect to the forward driving roller 31. The nip roller 31*n* abuts against the front surface of the web S in a state of being biased to the forward driving roller 31 side, and nips the web S between the nip roller 31*n* and the forward driving roller 31. According to this, a friction force is ensured between the forward driving roller 31 and the web S, and it is possible to reliably transport the web S by the forward driving roller 31.

The rotation drum 30 is, for example, a cylindrical drum which is supported to be rotatable in both of the normal direction Df and a reverse direction Dr reverse thereto by a supporting mechanism that is not illustrated, and has a diameter of 400 [mm], and the web S transported to the rearward driving roller 32 from the forward driving roller 31 is wound from the rear surface side. The rotation drum 30 supports the web S from the rear surface side while rotating to be driven in the normal direction Df of the web S by receiving the friction force between the rotation drum 30 and the web S. Incidentally, in the process portion 3, driven rollers 33 and 34 which fold back the web S on both sides of a winding portion to the rotation drum 30 are provided. The driven roller 33 of the driven rollers folds back the web S by winding the front surface of the web S between the forward driving roller 31 and the rotation drum 30. Meanwhile, the driven roller 34 folds back the web S by winding the front surface of the web S between the rotation drum 30 and the rearward driving roller 32. In this manner, by folding back the web S on each of the upstream side and the downstream side in the normal direction Df with respect to the rotation drum 30, it is possible to ensure the winding portion of the web S to the rotation drum 30 to be long.

The rearward driving roller 32 includes a plurality of fine projections formed by thermal spraying on an outer circumferential surface, and winds the web S transported via the driven roller 34 from the rotation drum 30, from the rear surface side. In addition, the rearward driving roller 32 transports the web S to the winding portion 4 by rotation thereof in a clockwise direction of FIG. 1. In addition, a nip roller 32*n* is provided with respect to the rearward driving roller 32. The nip roller 32*n* abuts against the front surface of the web S in a state of being biased to the rearward driving roller 32 side, and nips the web S between the nip roller 32*n* and the rearward driving roller 32. According to this, a friction force is ensured between the rearward driving roller 32 and the web S, and it is possible to reliably transport the web S by the rearward driving roller 32.

In this manner, the web S transported to the rearward driving roller 32 from the forward driving roller 31 is supported on the outer circumferential surface of the rotation drum 30. In addition, in the process portion 3, in order to record a color image on the front surface of the web S supported by the rotation drum 30, the plurality of recording heads 51 which correspond to colors different from each other are provided. Specifically, four recording heads 51 which correspond to yellow, cyan, magenta, and black are aligned in the normal direction Df in this color order. Each of the recording heads 51 opposes the front surface of the web S wound around the rotation drum 30 at a slight clearance, and discharges ink having a corresponding color (color ink) from a nozzle in an ink jet method. In addition, as each of the recording heads 51 discharges the ink to the web S transported in the normal direction Df, a color image is formed on the front surface of the web S.

In addition, as ink, ultraviolet (UV) ink (photo-curing ink) which is cured by being irradiated with an ultraviolet ray (light) is used. Here, in the process portion 3, in order to fix the ink to the web S by curing the ink, UV irradiators 61 and 62 (light irradiating portion) are provided. In addition, the ink curing is performed by dividing the process into two steps including temporary curing and main curing. Between each of the plurality of recording heads 51, the UV irradiator 61 for the temporary curing is disposed. In other words, as the ultraviolet ray having weak irradiation strength is irradiated by the UV irradiator 61, compared to a case where the ultraviolet ray is not irradiated, the ink is cured (temporarily cured) to the extent that the wet-spreading of the ink is sufficiently slow, and the ink is not mainly cured. Meanwhile, on the downstream side in the normal direction Df with respect to the plurality of recording heads 51, the UV irradiator 62 for the main curing is provided. In other words, by irradiating the ultraviolet ray having stronger irradiation strength than that of the UV irradiator 61, the UV irradiator 62 cures (mainly cures) the ink to the extent that the wet-spreading of the ink is stopped.

In this manner, the UV irradiator 61 disposed between each of the plurality of recording heads 51 temporarily cures the color ink discharged to the web S from the recording head 51 that is on the upstream side in the normal direction Df. Therefore, the ink discharged to the web S by one recording head 51 is temporarily cured until reaching the recording head 51 adjacent to the one recording head 51 that is on the downstream side in the normal direction Df. Accordingly, generation of mixed color which is mixing of color ink having different colors is suppressed. In a state where the mixed color is suppressed in this manner, the plurality of recording heads 51 discharge different color ink having different colors from each other, and form a color image on the web S. Furthermore, further on the downstream side in the normal direction Df than the plurality of recording heads 51, the UV irradiator 62 for the main curing is provided. Therefore, the color image formed by the plurality of recording heads 51 is mainly cured by the UV irradiator 62, and is fixed to the web S.

Furthermore, on the downstream side in the normal direction Df with respect to the UV irradiator 62, the recording head 51 is also provided. The recording head 51 opposes the front surface of the web S wound around the rotation drum 30 at a slight clearance, and discharges transparent UV ink from the nozzle to the front surface of the web S in the ink jet method. In other words, the transparent ink is further discharged to the color image formed by the recording heads 51 for four colors. The transparent ink is discharged to the entire surface of the color image, and imparts texture, such as glossy sense or matt sense, to the color image. In addition, on the downstream side in the normal direction Df with respect to the recording head 51 which discharges the transparent ink, the UV irradiator 63 is provided. As a strong ultraviolet ray is irradiated, the UV irradiator 63 mainly cures the transparent ink discharged by the recording head 51. According to this, it is possible to fix the transparent ink to the front surface of the web S.

In this manner, in the process portion 3, the discharge and the curing of the ink are appropriately performed with respect to the web S wound around the outer circumferential portion of the rotation drum 30, and the color image coated with the transparent ink is formed. In addition, the web S on which the color image is formed is transported to the winding portion 4 by the rearward driving roller 32.

In addition to the winding shaft 40 around which the end of the web S is wound, the winding portion 4 includes a driven roller 41 which winds the web S from the rear surface side between the winding shaft 40 and the rearward driving roller 32. In a state where the front surface of the web S is oriented to the outside, the winding shaft 40 winds and supports the end of the web S. In other words, when the winding shaft 40 rotates in a clockwise direction of FIG. 1, the web S transported from the rearward driving roller 32 is wound around the winding shaft 40 via the driven roller 41. Incidentally, the web S is wound around the winding shaft 40 via a core tube 42 which is attachable to and detachable from the winding shaft 40. Therefore, when the web S wound around the winding shaft 40 is full, it is possible to detach the web S from each core tube 42.

However, in the above-described the printer 1, a mark detection unit 7 is disposed between the forward driving roller 31 and the driven roller 33, and a detection region R70 (sensor spot) of a mark sensor 70 included in the mark detection unit 7 is set to be an end portion in the width direction Dw of the front surface of the web S. Meanwhile, in the end portion in the width direction Dw of the front surface of the web S, a plurality of marks M which are aligned in one row to be parallel to the normal direction Df are printed at an equivalent pitch. According to this, it is configured to be capable of grasping a transport position of the web S based on the result of detecting the mark M which passes through the detection region R70 in the normal direction Df or in the reverse direction Dr by the mark sensor 70.

Figure 2:
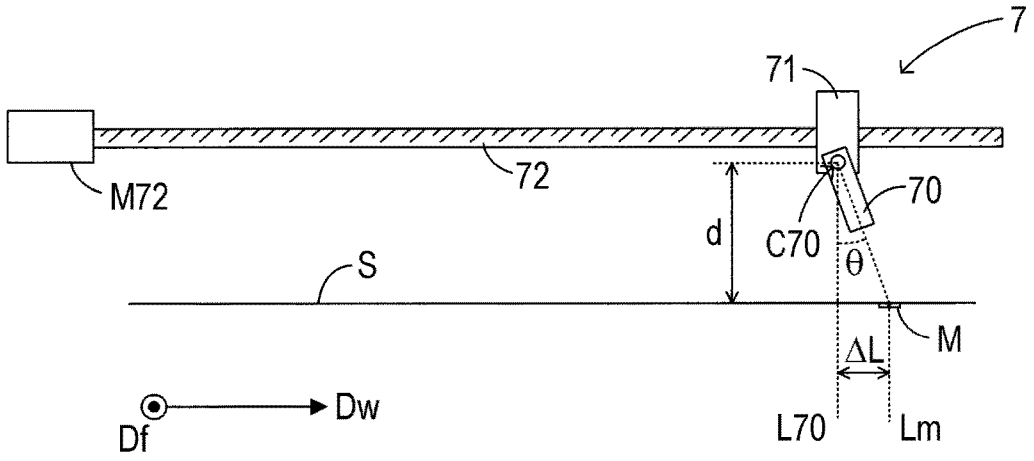
FIG. 2 is a side view illustrating a configuration of a mark detection unit.

FIG. 2 is a side view schematically illustrating a configuration of the mark detection unit. The mark sensor 70 included in the mark detection unit 7 is an optical sensor which has a light emitting element and a light receiving element, and detects the mark M by receiving the light that is diffused and reflected by the web S by the light receiving element while irradiating the front surface of the web S with the light from the light emitting element. As illustrated in FIG. 2, the mark detection unit 7 includes a supporting member 71 which supports the mark sensor 70 to be rotatable. Specifically, the mark sensor 70 can rotate around a rotation shaft C70 (rotation center line) parallel to the normal direction Df that is the transport direction of the web S, and the supporting member 71 can maintain a posture of the mark sensor 70 at each of a plurality of rotation angles θ around the rotation shaft C70. In addition, in FIG. 2, the angle θ is illustrated considering a virtual straight line through which the rotation shaft C70 passes being parallel to a normal line of the front surface of the web S as a reference.

Furthermore, the mark detection unit 7 includes a ball screw 72 which extends to be parallel to the width direction Dw, and a sensor motor M72 which rotates and drives the ball screw 72, and the supporting member 71 is attached to a nut of the ball screw 72. Therefore, it is possible to move the mark sensor 70 in the width direction Dw together with the supporting member 71 by rotating the ball screw 72 by the sensor motor M72. In particular, in the embodiment, by adjusting a position L70 of the mark sensor 70 in the width direction Dw in accordance with the rotation angle θ of the mark sensor 70, the position of the detection region R70 with respect to a position Lm of the mark M is performed. Specifically, when a distance between the rotation shaft C70 of the mark sensor 70 and the front surface of the web S in the normal line direction of the front surface of the web S is a distance d, the position L70 of the mark sensor 70 is shifted from the position Lm of the mark M only by a correction distance ΔL (=d×tan θ) in the width direction Dw. According to this, the detection region R70 of the mark sensor 70 is in the mark M in the width direction Dw. Here, when viewed from the side illustrated in FIG. 2, the position L70 of the mark sensor 70 is representative at a position of the rotation shaft C70, and the position Lm of the mark M is representative at a position of the center of the mark M.

Figure 3:
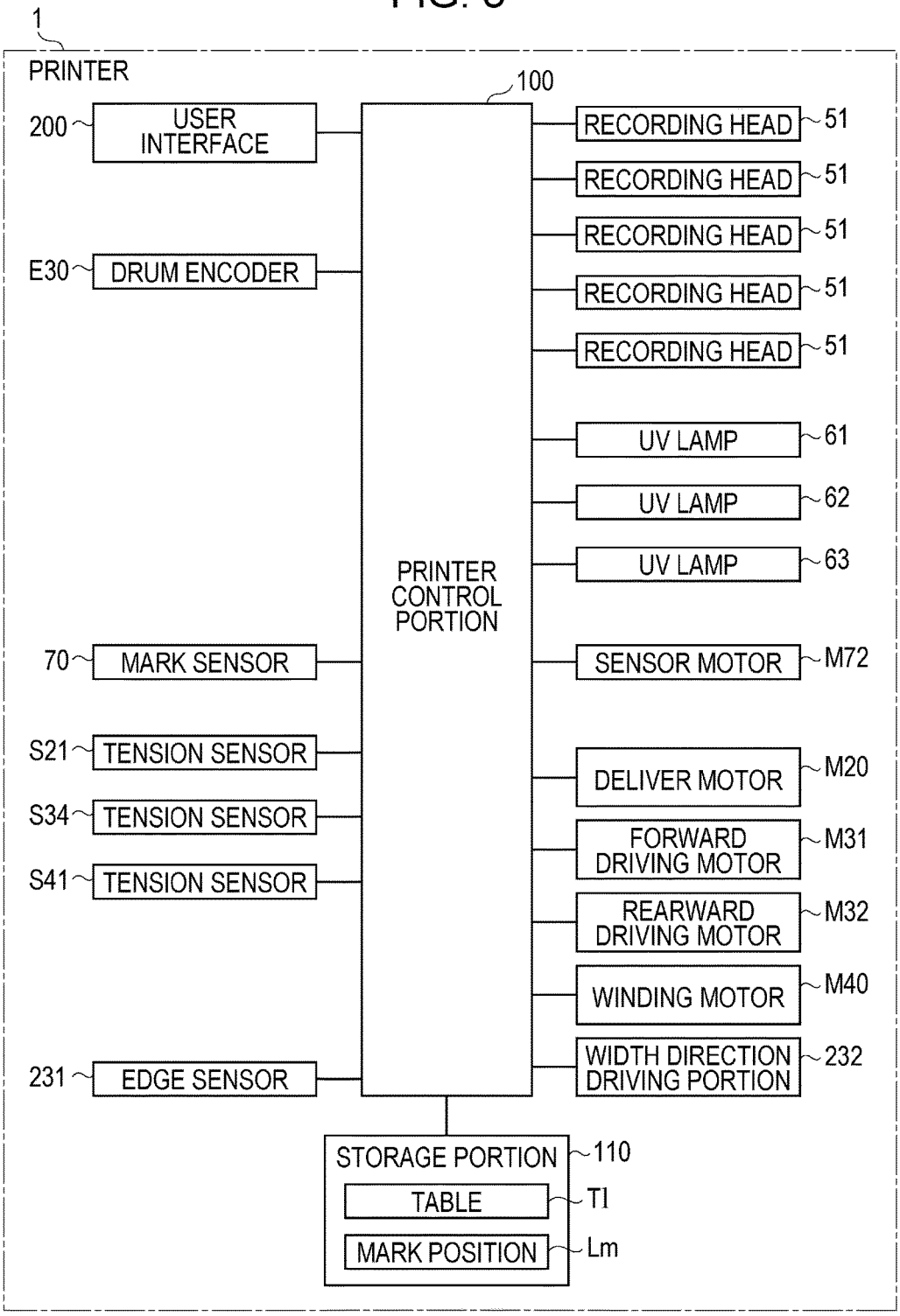
FIG. 3 is a view illustrating an electric configuration which controls the printer illustrated in FIG. 1.

The description above is an outline of the apparatus configuration of the printer 1. Next, an electric configuration which controls the printer 1 will be described. FIG. 3 is a block diagram illustrating the electric configuration which controls the printer illustrated in FIG. 1. As illustrated in FIG. 3, in the printer 1, a printer control portion 100 which achieves a function of integrally controlling each portion of the apparatus, and a storage portion 110 which stores various programs or data used in the control by the printer control portion 100, are provided. The printer control portion 100 is a computer configured of a central processing unit (CPU) or a random access memory (RAM), and the storage portion 110 is a storage apparatus configured of a hard disk drive (HDD).

In addition, in the printer 1, a user interface 200 which functions as an interface between the printer control portion 100 and a user is provided. The user interface 200 is configured of input equipment, such as a mouse or a keyboard, and output equipment, such as a display. Therefore, the user can input a desirable command to the printer control portion 100 by operating the input equipment of the user interface 200, and can confirm an operation situation of the printer 1 by confirming the output equipment of the user interface 200. In addition, it is not necessary to configure the input equipment and the output equipment to be separated from each other, and the input equipment and the output equipment may be configured to be integrated with each other by a touch panel display or the like.

In addition, the printer control portion 100 controls each portion of the apparatus of the recording head, the UV irradiator, and a web transport system, based on the command input by the user via the user interface 200 and the command received from other external equipment. The specific control is as follows.

The printer control portion 100 controls an ink discharge timing of each of the recording heads 51 which form the color image in accordance with the transport of the web S. Specifically, the control of the ink discharge timing is performed based on an output (detected value) of a drum encoder E30 which is attached to a rotation shaft of the rotation drum 30 and detects a rotation position of the rotation drum 30. In other words, in order to allow the rotation drum 30 to be driven to be rotated according to the transport of the web S, an output value of drum encoder E30 which detects the rotation position of the rotation drum 30, that is, the transport position of the web S, is illustrated. Here, as the printer control portion 100 generates a print timing signal (pts) signal from the output value of the drum encoder E30, and controls the ink discharge timing of each of the recording heads 51 based on the pts signal, the ink discharged by each of the recording heads 51 lands at a target position of the transported web S, and the color image is formed.

In addition, the timing at which the recording head 51 for the transparent ink discharges the ink is also similarly controlled by the printer control portion 100 based on the output value of the drum encoder E30. According to this, it is possible to accurately discharge the transparent ink to the color image formed by four colors of the recording heads 51. Furthermore, a timing of turning on and off or the irradiation amount of the UV irradiators 61, 62, and 63, is also controlled by the printer control portion 100.

Furthermore, the timing at which each of the recording heads 51 starts the discharge of the ink is also controlled using the result of detecting the mark M by the mark sensor 70. In other words, the printer control portion 100 stores the output value of the drum encoder E30 when the mark M that indicates a printing start position among the plurality of marks M is positioned within a predetermined range on the upstream side in the normal direction Df from the detection region R70, as a reference value in the storage portion 110. In addition, when starting the transport of the web S in the normal direction Df, the printer control portion 100 controls the start timing of the ink discharge from each of the recording heads 51 based on the timing at which the mark sensor 70 detects the mark M after the output value of the drum encoder E30 matches the reference value. According to this, it is possible to appropriately start the printing of the image from the predetermined position of the web S.

In addition, the printer control portion 100 administers a function of controlling the transport of the web S described in detail by using FIG. 1. The transport control of the web S is mainly configured of a steering control and a tension control of the web S. The steering control is performed by using the steering mechanism 23 provided in the delivery portion 2. In other words, the printer control portion 100 feedback-controls the position of the web S in the width direction by adjusting the position in the width direction of the delivery shaft 20 and the driven roller 21 by the width direction driving portion 232 in accordance with a detection result of the edge sensor 231. In addition, the tension control is performed by using a motor connected to the delivery shaft 20, the forward driving roller 31, the rearward driving roller 32, and the winding shaft 40 among the members that configure the web transport system. The specific tension control of the web S is as follows.

The printer control portion 100 rotates a delivery motor M20 which drives the delivery shaft 20 by a direct driving method, and supplies the web S to the forward driving roller 31 from the delivery shaft 20. At this time, the printer control portion 100 controls torque of the delivery motor M20, and adjusts the tension (delivery tension Ta) of the web S to the forward driving roller 31 from the delivery shaft 20. In other words, a tension sensor S21 which detects the size of the delivery tension Ta is attached to the driven roller 21 disposed between the delivery shaft 20 and the forward driving roller 31. The tension sensor S21 can be configured of, for example, a load cell which detects the size of a force received from the web S. In addition, the printer control portion 100 feedback-controls the torque of the delivery motor M20, and adjusts the delivery tension Ta of the web S based on the detection result (detected value) of the tension sensor S21.

In addition, the printer control portion 100 rotates a forward driving motor M31 which drives the forward driving roller 31, and a rearward driving motor M32 which drives the rearward driving roller 32. Accordingly, the web S delivered from the delivery portion 2 passes through the process portion 3. At this time, while a speed control is performed with respect to the forward driving motor M31, a torque control is performed with respect to the rearward driving motor M32. In other words, the printer control portion 100 feedback-controls the rotation speed of the forward driving motor M31 based on the output of the encoder of the forward driving motor M31. According to this, the web S is transported at the target position by the forward driving roller 31.

Meanwhile, the printer control portion 100 controls the torque of the rearward driving motor M32, and adjusts the tension (process tension Tb) of the web S from the forward driving roller 31 to the rearward driving roller 32. In other words, a tension sensor S34 which detects the size of the process tension Tb is attached to a driven roller 34 disposed between the rotation drum 30 and the rearward driving roller 32. The tension sensor S34 can be configured of, for example, a load cell which detects the size of a force received from the web S. In addition, the printer control portion 100 feedback-controls the torque of the rearward driving motor M32, and adjusts the process tension Tb of the web S based on the detection result (detected value) of the tension sensor S34.

In addition, the printer control portion 100 rotates a winding motor M40 which drives the winding shaft 40 by a direct driving method, and winds the web S transported by the rearward driving roller 32 around the winding shaft 40. At this time, the printer control portion 100 controls torque of the winding motor M40, and adjusts the tension (winding tension Tc) of the web S to the winding shaft 40 from the rearward driving roller 32. In other words, a tension sensor S41 which detects the size of the winding tension Tc is attached to the driven roller 41 disposed between the rearward driving roller 32 and the winding shaft 40. The tension sensor S41 can be configured of, for example, a load cell which detects the size of a force received from the web S. In addition, the printer control portion 100 feedback-controls the torque of the winding motor M40, and adjusts the winding tension Tc of the web S based on the detection result (detected value) of the tension sensor S41.

In addition, the printer control portion 100 performs printing processing of printing a two-dimensional image on the front surface of the web S by discharging the ink to the recording head 51 while transporting the web S in the normal direction Df by the motors M20, M31, M32, and M40. In particular, as described above, a timing at which each of the recording heads 51 starts the discharge of the ink is controlled based on the timing at which the mark sensor 70 detects the mark M. Therefore, in order to start the printing from an appropriate position of the web S, it is important to accurately detect the mark M by the mark sensor 70.

However, since an optimized value which corresponds to the type (that is, reflectivity or the like) of the web S exists in the rotation angle θ of the mark sensor 70, there is a case where the mark M is not accurately detected since the rotation angle θ of the mark sensor 70 is not appropriate. Here, in order to optimize the rotation angle θ of the mark sensor 70 in accordance with the type of the web S, the printer control portion 100 stores a table T1 in the storage portion 110 in advance. In other words, in the storage portion 110, the table T1 which indicates the rotation angle θ of the mark sensor 70 that corresponds to the type of the web S is stored. In addition, the table T1 can be acquired from the result of performing experiment of detecting the mark M by the mark sensor 70 with respect to various types of the webs S in advance while changing the rotation angle θ of the mark sensor 70.

In addition, the printer control portion 100 displays that the rotation angle θ of the mark sensor 70 matches the angle which corresponds to the type of the web S indicated by the table T1, on the user interface 200. According to this, the user can appropriately set the rotation angle θ of the mark sensor 70. However, when the rotation angle θ of the mark sensor 70 varies, a case where the position of the detection region R70 varies in the width direction Dw, and the positional relationship between the detection region R70 and the mark M is not appropriate, is assumed. In this case, it is difficult to detect the mark M of the transported web S by the mark sensor 70. In particular, when transporting the web S in the reverse direction Dr, the steering mechanism 23 is not operated, and thus, the meandering of the web S becomes remarkable, and the detection of the mark M by the mark sensor 70 becomes extremely difficult. Here, the printer control portion 100 performs processing of adjusting the position in the width direction Dw of the mark sensor 70 based on the position Lm of the mark M stored in the table T1 and the rotation angle θ of the mark sensor 70. Next, an example of the control will be described.

Figure 4:
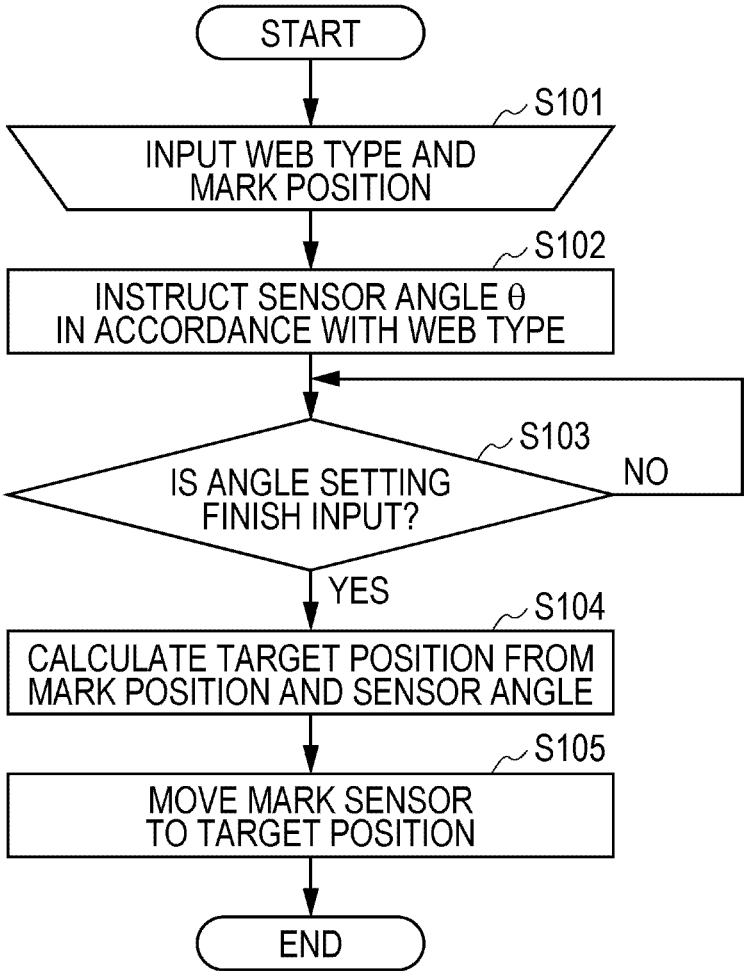
FIG. 4 is a flowchart illustrating a first example of position adjustment of a mark sensor.

FIG. 4 is a flowchart illustrating a first example of a position adjustment of the mark sensor. In step S101, the type of the web S and the position of the mark M are input to the user interface 200 by the user and are stored in the storage portion 110. Here, the position (input position) at which the user inputs the mark M is, for example, a distance in the width direction Dw from the end of the web S to the end of the mark M. In addition, when storing the mark M in the storage portion 110, the position shifted to the inner side from the input position only by an offset distance that corresponds to the distance from the end of the mark M to the center in the width direction Dw, is stored as the position Lm of the mark M.

In step S102, the printer control portion 100 acquires the type of the web S input to the user interface 200 and the angle which is appropriate for the type of the web S from the table T1 in the storage portion 110, and displays that the rotation angle θ of the mark sensor 70 is set to the angle on the user interface 200. In addition, when it is confirmed that a content that the angle setting of the mark sensor 70 is finished is input to the user interface 200 ("YES" in step S103) by the user, the target position of the mark sensor 70 in the width direction Dw is calculated based on the position Lm of the mark M stored in the storage portion 110 and the rotation angle θ which corresponds to the type of the web S (step S104). In addition, in step S105, the mark sensor 70 is moved to the target position acquired in step S104.

As described above, in the embodiment, by adjusting the position in the width direction Dw of the mark sensor 70 based on the rotation angle θ of the mark sensor 70, the positions in the width direction Dw of the detection region R70 and the mark M are matched. Therefore, it is possible to appropriately maintain the positional relationship between the detection region R70 of the mark sensor 70 and the mark M regardless of the rotation angle θ of the mark sensor 70.

In addition, the storage portion 110 which stores the position Lm of the mark M in the width direction Dw therein is provided. In addition, the position in the width direction Dw of the mark sensor 70 is adjusted based on the position Lm of the mark M stored in the storage portion 110 and the rotation angle θ of the mark sensor 70 determined from the type of the web S, and the positions in the width direction Dw of the detection region R70 and the mark M are matched. In the configuration, it is possible to appropriately position the detection region R70 of the mark sensor 70 with respect to the mark M based on the position Lm of the mark M in the width direction Dw stored in the storage portion 110 and the rotation angle θ of the mark sensor 70.

In addition, the user interface 200 which receives the input of the information that indicates the position of the mark M in the width direction Dw is provided. In the storage portion 110, the position Lm of the mark M indicated by the information input to the user interface 200 is stored. In the configuration, it is possible to simply obtain the position Lm of the mark M in the width direction Dw based on the input to the user interface 200.

In addition, the user interface 200 which receives the input of the type of the web S is provided, and the printer control portion 100 displays the instruction which adjusts the rotation angle θ of the mark sensor 70 to the angle that corresponds to the type of the web S input to the user interface 200, on the user interface 200. Furthermore, the printer control portion 100 determines the rotation angle θ of the mark sensor 70 based on the type of the web S input to the user interface 200. In the configuration, it is possible to adjust the rotation angle θ of the mark sensor 70 to the appropriate angle that corresponds to the type of the web S, and to appropriately maintain the positional relationship between the detection region R70 of the mark sensor 70 and the mark M regardless of the rotation angle θ of the mark sensor 70.

In this manner, in the embodiment, the printer 1 corresponds to an example of "printing apparatus" of the invention, the mark sensor 70 corresponds to an example of "mark detector" of the invention, the detection region R70 corresponds to an example of "detection region" of the invention, the rotation shaft C70 corresponds to an example of "rotation shaft" of the invention, the rotation angle θ corresponds to an example of "rotation angle" of the invention, the web S corresponds to an example of "recording medium" of the invention, the mark M corresponds to an example of "mark" of the invention, the ball screw 72 and the sensor motor M72 cooperate with each other and function as an example of "driving portion" of the invention, the width direction Dw corresponds to an example of "first direction" of the invention, the direction in which the rotation shaft C70 extends, that is, the normal direction Df corresponds to an example of "second direction" of the invention, the printer control portion 100 corresponds to an example of each of "angle determination portion" and "control portion" of the invention, the storage portion 110 corresponds to an example of "storage portion" of the invention, and the user interface 200 corresponds to an example of each of "mark position input portion", "medium type input portion", and "angle support portion" of the invention.

In addition, the invention is not limited to the above-described embodiment, and it is possible to add various changes to the above-described embodiment as long as the changes do not depart from the idea. Therefore, the printer 1 may be configured as illustrated in the following example. In addition, hereinafter, a difference from the above-described embodiment will be mainly described, and common configuration elements are given the same reference numerals and the description thereof will be omitted. However, it is needless to say that similar effects are achieved by providing the configuration common to those described above.

Figure 5:
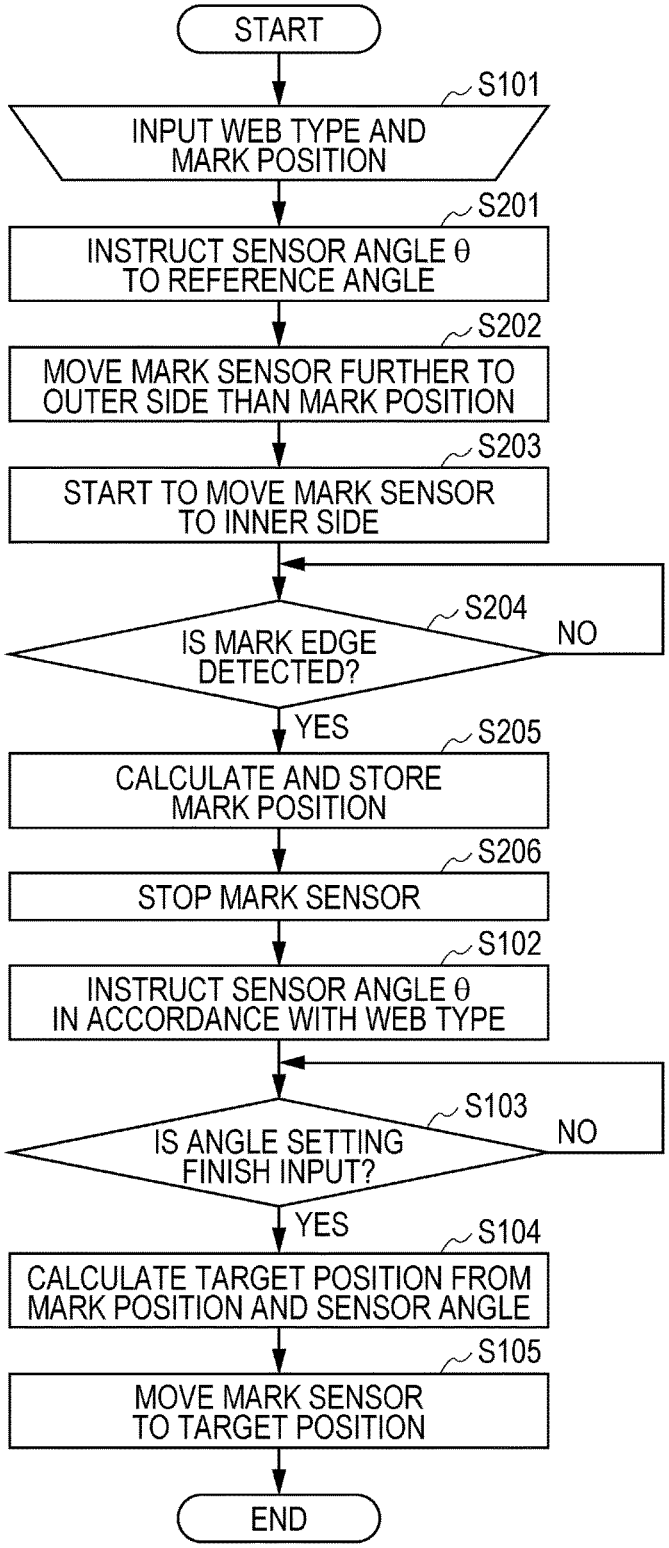
FIG. 5 is a flowchart illustrating a second example of position adjustment of the mark sensor.

FIG. 5 is a flowchart illustrating a second example of the position adjustment of the mark sensor. The second example illustrated in FIG. 5 is different from the first example of FIG. 4 in that steps S201 to S206 are performed between step S101 and step S102. In step S201, the instruction which sets the rotation angle θ of the mark sensor 70 to be a reference angle (for example, 0°) is displayed on the user interface 200. In addition, the mark sensor 70 moves further to the outer side in the width direction Dw than the position Lm of the mark M (step S202). Specifically, the mark sensor 70 moves to a position at which the detection region R70 is shifted to the outer side in the width direction Dw from the mark M. Next, the mark sensor 70 starts to move toward the inner side in the width direction Dw (step S203), and the printer control portion 100 monitors whether or not the mark sensor 70 detects an edge of the mark M (step S204). When the detection of the edge of the mark M is confirmed ("YES" in step S204), the position Lm of the mark M is calculated and stored in the storage portion 110 based on the position of the mark sensor 70 at this time (step S205). In addition, after the movement of the mark sensor 70 is stopped in step S206, steps S102 to S105 are performed similar to the description above by using the position Lm of the mark M stored in the storage portion 110.

In this manner, in the second example illustrated in FIG. 5, the printer control portion 100 confirms the position Lm of the mark M in the width direction Dw based on the result of monitoring the detected value of the mark sensor 70 while moving the mark sensor 70 in the width direction Dw. In addition, the storage portion 110 stores the position Lm of the mark M confirmed by the printer control portion 100. In the configuration, it is possible to obtain the position Lm of the mark M in the width direction Dw with high accuracy.

Figure 6:
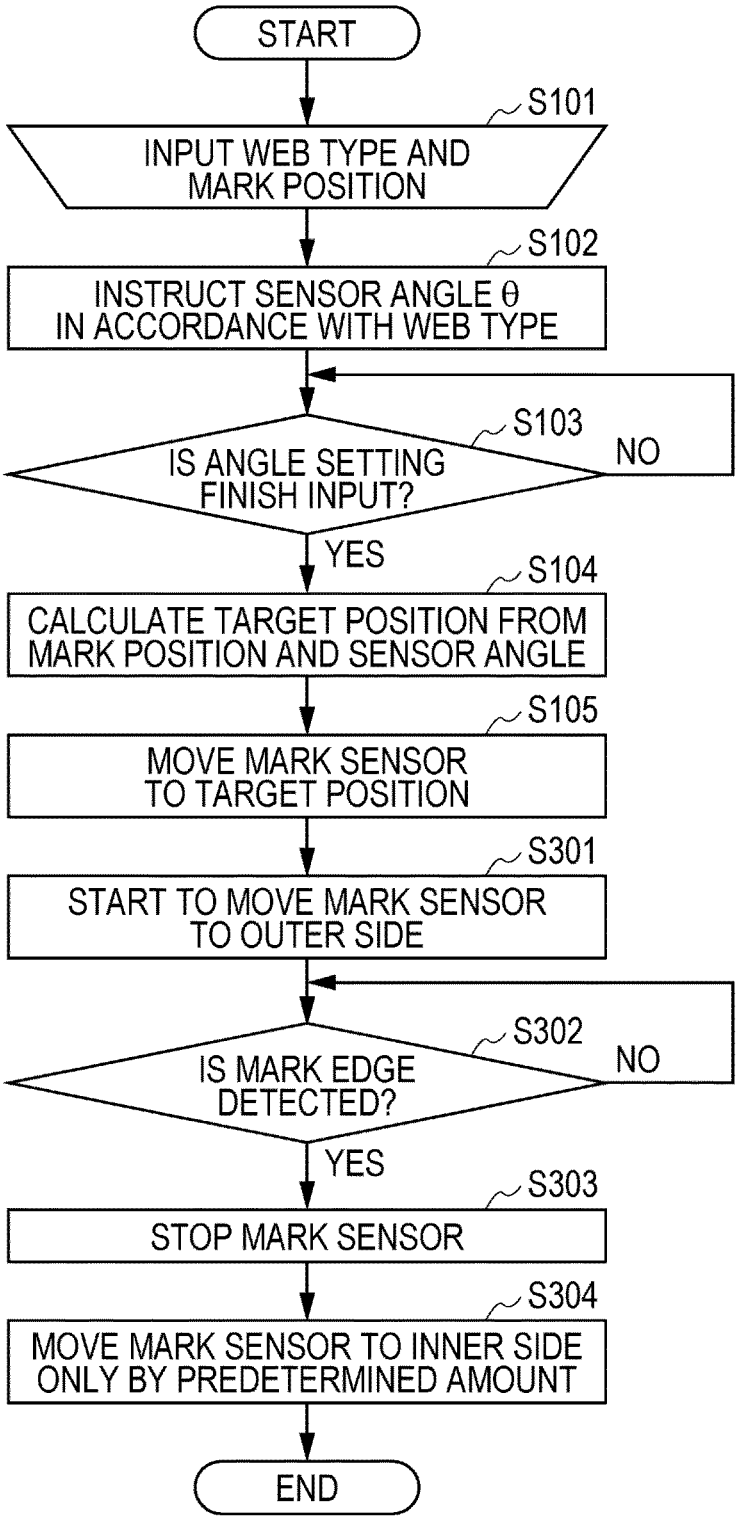
FIG. 6 is a flowchart illustrating a third example of position adjustment of the mark sensor.

FIG. 6 is a flowchart illustrating a third example of the position adjustment of the mark sensor. The third example illustrated in FIG. 6 is different from the first example of FIG. 4 in that steps S301 to S304 are performed after step S105. In other words, after the mark sensor 70 moves to the target position in step S105, the mark sensor 70 starts to further move to the outer side in the width direction Dw (step S301), and the printer control portion 100 monitors whether or not the mark sensor 70 detects the edge of the mark M (step S302). When the detection of the edge of the mark M is confirmed ("YES" in step S302), the mark sensor 70 stops (step S303). Next, in step S304, by moving the mark sensor 70 to the inner side only by the predetermined amount (for example, the above-described offset distance) in the width direction Dw, the positions of the detection region R70 of the mark sensor 70 and the mark M are matched.

In addition, in the above-described embodiment, in step S304, by moving the mark sensor 70 to the inner side only by the predetermined amount in the width direction Dw, the positions of the detection region R70 of the mark sensor 70 and the mark M are matched. However, after moving the mark sensor 70 to the inner side only by the distance (for example, two times the predetermined amount) which is greater than the predetermined amount in the width direction Dw and stopping the movement of the mark sensor 70, by stopping the movement of the mark sensor 70 after further moving the mark sensor only by the predetermined amount in the direction (outer side in the width direction Dw) reverse to the previous direction in the width direction Dw, the positions of the detection region R70 of the mark sensor 70 and the mark M may be matched. In such a method, the positions of the detection region R70 and the mark M are matched in order to avoid generation of position shift by receiving influence of backlash due to a change in moving direction when the mark sensor 70 moves along the ball screw 72.

In addition, in the above-described embodiment, it is determined that the angle displayed on the user interface 200 is the rotation angle θ of the mark sensor 70 based on the table T1 and the type of the web S. However, a configuration in which an angle detector which detects the rotation angle θ of the mark sensor 70 is provided and the rotation angle θ of the mark sensor 70 is determined based on the detection result of the angle detector, may be employed.

In addition, a configuration in which the adjustment of the rotation angle θ of the mark sensor 70 is not performed by the user and is performed by a motor or the like which rotates and drives the mark sensor 70, may be employed.

In addition, it is not necessary that the direction of the rotation shaft C70 of the mark sensor 70 is orthogonal to the width direction Dw as described above, that is, parallel to the normal direction Df, and the direction can be an appropriate direction intersecting with the width direction Dw.

In addition, a specific configuration of the mark sensor 70 is not limited to the above-described example. Therefore, the mark sensor 70 may be, for example, a sensor which receives regular reflection light.

This application claims priority under 35 U.S.C. §119 to Japanese Patent Application No. 2016-087877, filed Apr. 26, 2016. The entire disclosure of Japanese Patent Application No. 2016-087877 is hereby incorporated herein by reference.

What is claimed is:

1. A printing apparatus comprising:

a mark detector which detects a mark that is formed on a recording medium and has a width in a first direction in a detection region thereof, and is supported to be rotatable around a rotation shaft that is parallel to a second direction intersecting with the first direction;

a driving portion which drives the mark detector in the first direction;

an angle determination portion which determines a rotation angle of the mark detector that considers the rotation shaft as a center; and a control portion which matches positions of the detection region and the mark in the first direction by adjusting a position of the mark detector in the first direction by the driving portion based on the rotation angle of the mark detector which is determined by the angle determination portion.

2. The printing apparatus according to claim 1, further comprising:

a storage portion which stores the position of the mark in the first direction, wherein the control portion matches positions of the detection region and the mark in the first direction by adjusting the position of the mark which is stored in the storage portion and a position in the first direction of the mark detector by the driving portion based on the rotation angle of the mark detector which is determined by the angle determination portion.

3. The printing apparatus according to claim 2, further comprising:

a mark position input portion which receives an input of information indicating the position of the mark in the first direction, wherein the storage portion stores the position of the mark indicated by the information input to the mark position input portion.

4. The printing apparatus according to claim 2, wherein the control portion confirms the position of the mark in the first direction based on a result of monitoring a detected value of the mark detector while moving the mark detector in the first direction by the driving portion, and wherein the storage portion stores the position of the mark confirmed by the control portion.

5. The printing apparatus according to claim 1, further comprising:

a medium type input portion which receives an input of a type of the recording medium; and an angle instruction portion which gives an instruction to adjust the rotation angle of the mark detector to an angle which corresponds to the type of the recording medium input to the medium type input portion, wherein the angle determination portion determines the rotation angle of the mark detector based on the type of the recording medium input to the medium type input portion.

6. A position adjusting method of a mark detector, comprising:

driving a mark detector which detects a mark that is formed on a recording medium and has a width in a first direction in a detection region thereof, and is supported to be rotatable around a rotation shaft that is parallel to a second direction intersecting with the first direction, in the first direction, wherein, in the driving of the mark detector in the first direction, positions of the detection region and the mark are matched in the first direction by adjusting a position of the mark detector in the first direction based on a rotation angle of the mark detector that considers the rotation shaft as a center.

* * * * *